US005845440A

United States Patent [19]

Matsuyama et al.

[11] Patent Number: 5,845,440

[45] Date of Patent: Dec. 8, 1998

[54] CLADDING UNITS FOR BUILDING AND SEAL STRUCTURE FOR JOINT THEREOF

[75] Inventors: Masahiro Matsuyama, Omiya; Fumihiro Yano, Toyama, both of Japan

[73] Assignee: YKK Corporation, Tokyo, Japan

[21] Appl. No.: 684,300

[22] Filed: Jul. 18, 1996

[30] Foreign Application Priority Data

Jul. 21, 1995 [JP] Japan ..... 7-185463
Feb. 28, 1996 [JP] Japan ..... 8-041853

[51] Int. Cl.[6] ..... E04B 2/96

[52] U.S. Cl. ..... 52/235; 52/396.1; 52/393; 52/460; 52/464; 52/483.1; 52/582.1

[58] Field of Search ..... 52/235, 396.1, 52/393, 483.1, 460, 464, 582.1, 582.2, 396.05, 396.04

[56] References Cited

U.S. PATENT DOCUMENTS

| | | | |
|---|---|---|---|
| 2,914,936 | 12/1959 | Reinhold | 52/235 |
| 3,320,706 | 5/1967 | Elliot et al. | 52/393 |
| 3,733,766 | 5/1973 | Leclercq | 52/460 X |
| 4,121,396 | 10/1978 | Oogami et al. | 52/235 |
| 4,403,980 | 9/1983 | Simpson et al. . | |
| 4,761,927 | 8/1988 | O'Keefe et al. | 52/582.1 X |
| 4,873,806 | 10/1989 | Jeschke | 52/235 |
| 4,999,960 | 3/1991 | Herwegh et al. | 52/235 |
| 5,709,056 | 1/1998 | Matsuyama et al. | 52/235 |

FOREIGN PATENT DOCUMENTS

| | | |
|---|---|---|
| 1 465 977 | 3/1977 | United Kingdom . |
| 1 504 149 | 3/1978 | United Kingdom . |
| 2 182976 A | 5/1987 | United Kingdom . |
| 2 239 879 A | 7/1991 | United Kingdom . |

OTHER PUBLICATIONS

Engineering News–Record Apr. 27, 1961, p. 50, "Stripping Zips Up Curtain Wall".

*Primary Examiner*—Robert Canfield
*Attorney, Agent, or Firm*—Hill & Simpson

[57] ABSTRACT

Cladding units for a building and a seal structure for the joints thereof are disclosed. A cladding unit comprises a cladding member consisting of a framework and a face member attached to one side face thereof and fastener stringers for waterproof slide fasteners attached one each to the outer lateral parts of the cladding member. In a seal structure for the joint to be formed between the opposed frameworks of the cladding units mutually adjoined and attached to the backing member on the building, the joint formed between the adjoining cladding units is sealed by uniting the engaging parts of the opposed fastener stringers of these cladding units and the gap between the end parts of the fastener stringers and the gap between these end parts and the backing member of the building are sealed by filling the gaps with a wet sealing material.

7 Claims, 22 Drawing Sheets

CLADDING UNITS FOR BUILDING AND SEAL STRUCTURE FOR JOINT THEREOF

BACKGROUND OF THE INVENTION

1. Field of the Invention

This invention relates to cladding units or facing units for forming the outer wall of a building and a structure for sealing a joint between adjoining cladding units.

2. Description of the Prior Art

As one form of the outer wall of a building, the unit type curtain wall that is formed by joining curtain walls side by side vertically and laterally as attached to the skeleton frame of a building is known. Generally, the curtain wall units each comprise a framework, a panel or screen fitted to the framework, and a dry seal member fitted to the perimeter of the framework.

When the curtain wall units mentioned above are attached as vertically and laterally adjoined to one another to the skeleton frame of a given building, the seal members of these adjoining curtain wall units are pressed against one another and the joints consequently formed therebetween are sealed. It is, however, very difficult to press the seal members correctly against one another. Even when they are correctly pressed, the joints are not always sealed fully effectively. Usually, therefore, the joints between the adjoining curtain wall units are sealed by filling the joints with a wet sealing material. This work of filling the joints with the wet sealing material turns out to be very irksome.

SUMMARY OF THE INVENTION

It is, therefore, an object of the present invention to provide cladding units or facing units and a seal structure for the joints thereof which are liberated from the problems mentioned above.

In accordance with one aspect of the present invention, there is provided a cladding unit which comprises a cladding member comprised of a framework and a face member attached to one side face thereof and fastener stringers for a waterproof slide fastener attached one each to the outer lateral parts of the cladding member. According to this structure, the joint between two adjoining cladding units can be simply and infallibly sealed by uniting the opposed fastener stringers of the cladding units.

In a preferred mode of this aspect of the invention, the fastener stringers mentioned above each comprise a waterproof tape and an engaging part provided with a multiplicity of coupling elements attached to the waterproof tape as spaced at fixed intervals along one longitudinal edge thereof, with the engaging part so disposed that one end part thereof will protrude from one end part of the waterproof tape in the direction of length thereof. When the opposed fastener stringers of the adjoining cladding units are to be united, therefore, the insertion thereof into a slider is facilitated because the relevant engaging parts protruding on one end side thereof from the corresponding waterproof tapes can be drawn out from between the adjoining cladding units and inserted into the slide groove of the slider.

Another aspect of the present invention consists in providing a seal structure for the joint to be formed between the opposed frameworks of the cladding units mutually adjoined and attached to the backing member of the building. In a basic mode of this aspect of the invention, the joint formed between the adjoining cladding units is sealed by uniting the engaging parts of the opposed fastener stringers of these cladding units and the gap between the end parts of the fastener stringers and the gap between these end parts and the backing member of the building are sealed by filling the gaps with a wet sealing material.

In a preferred mode of this aspect of the present invention, a boxlike backup member provided with projecting parts each having a cross section roughly in the shape of three sides of a square and adapted to thrust out between the end part of the fastener stringer and the backing member of the building is disposed between the end parts of the adjoining fastener stringers so that the opening part thereof will confront the rear sides of the end parts of the fastener stringers and the gap between the end parts of the fastener stringers is sealed by filling the empty space in the backup member with a wet sealing material. Appropriately, the framework of the cladding unit is provided on each of the outer lateral surfaces thereof with two parallel elongate ribs extended in the direction of length of the surfaces as raised therefrom so that the longitudinal edge part of the fastener stringer opposite the engaging part thereof will be press fit preferably with a linear retaining member into a groove which is formed by the two ribs. The face member of the cladding unit is attached to the framework in such a manner that the edges thereof will protrude from the framework. The boundary between the framework and the face member is sealed by filling the gap arising between the edges of the face member and one of the ribs defining the groove with a wet sealing material.

As one mode of the seal structure for the joint between the edge parts of fastener stringers, a seal structure is provided which is capable of sealing a cruciform joint to be formed by four vertically and laterally adjoining cladding units with a wet sealing material. In this seal structure, the lateral joints between the vertically adjoining cladding units and the vertical joints between the laterally adjoining cladding units are sealed by uniting the engaging parts of the opposed fastener stringers of the relevant cladding units. At the cruciform joint resulting from the intersection between the lateral joints and the vertical joints, a backup member having a generally cruciform plan figure is disposed in such a manner that the projecting parts thereof will thrust out in the rear sides of the end parts of the relevant fastener stringers. The cruciform joint is sealed by filling the empty space of the cruciform backup member with a wet sealing material.

As another mode of the seal structure, there is provided a seal structure which is capable of sealing a T-shaped joint to be formed between a first and a second cladding unit which adjoin each other and a third cladding unit which adjoins the two cladding units with a wet sealing material. In this seal structure, the first joint between the first and second adjoining cladding units, the second joint between the first and third adjoining cladding units, and the third joint between the second and third cladding units are sealed severally by uniting the engaging parts of the opposed fastener stringers of the relevant cladding units. At the T-shaped joint resulting from the intersection between the first, second, and third joints mentioned above, a backup member having a generally T-shaped plan figure is disposed in such a manner that the projecting parts thereof will thrust out in the rear sides of the end parts of the relevant fastener stringers. The T-shaped joint is sealed by filling the empty space of the T-shaped backup member with a wet sealing material.

As yet another mode of the seal structure, a seal structure is provided which is capable of sealing the end part joint between the end parts of a first and a second cladding unit which adjoin each other and a wall in an opening of a building with a wet sealing material. In this seal structure, the joint between the first and second cladding units is sealed by uniting the engaging parts of the opposed fastener stringers of the first and second cladding units. In the end part in which the joint between the first and second cladding units confronts the wall surface in the opening of the building, an end part backup member is disposed so as to thrust out in the rear sides of the relevant fastener stringers. The opening between the end parts of the first and second cladding units and the end parts of the fastener stringers is sealed by filling the empty space of the end part backup member with a wet sealing material. The gap between the first and the second cladding unit and the wall in the opening of the building is sealed by filling this gap with a wet sealing material.

As still another mode of the seal structure, a seal structure is provided which is capable of sealing with a wet sealing material the joint to be formed where an obstacle thrusting out the boundary of a first and a second cladding unit which would otherwise adjoin each other borders on the first and second cladding units. In this seal structure, depressed parts adapted jointly to conform to the contour of the obstacle are formed in the first and second cladding units, with the relevant fastener stringers interrupted in continuity by the depressed parts. The joints bordering on the opposite boundaries of the obstacle are sealed by filling the gaps between the depressed parts of the cladding units and the obstacle with a wet sealing material and uniting the engaging parts of the opposed fastener stringers attached to the first and second cladding units. In each of the end parts in which the opposite joints border on the obstacle, a backup member is disposed so as to thrust out in the rear sides of the united fastener stringers. The empty spaces in the backup members are filled with a wet sealing material to connect the fastener stringers with the wet sealing material in the depressed parts of the cladding units. The gaps between the wet sealing materials and the obstacle are sealed by filling the opening with a wet sealing material.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

Figure 1:
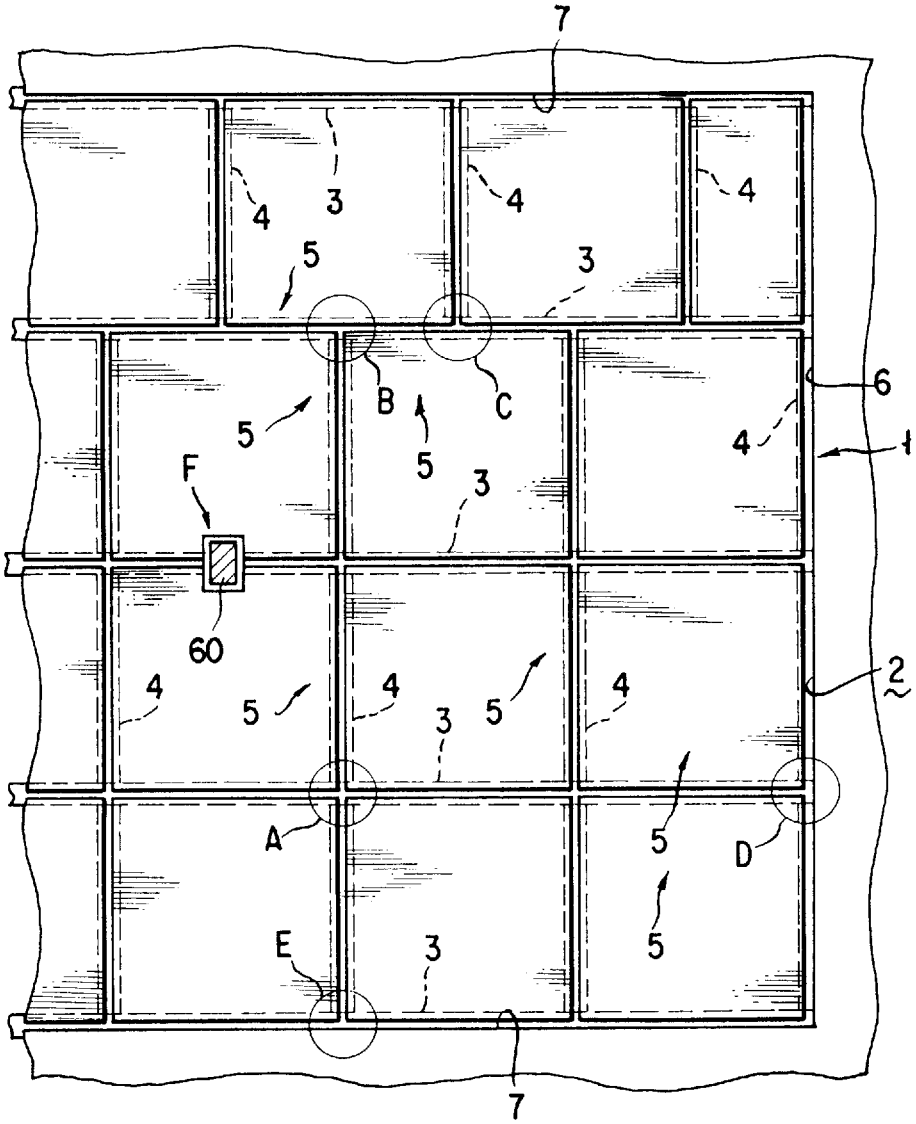
FIG. 1 is a schematic front view showing the state in which cladding units are fixed to the skeleton frame of a building.

A plurality of lateral backing members 3 made of steel and a plurality of vertical backing members 4 made of steel are fixed in an opening 2 in a skeleton frame of a building 1 and cladding units 5 are fixed to the outdoor sides of the upper and lower lateral backing members 3 and the left and right vertical backing members 4 as shown in FIG. 1. The end part joints between the cladding units 5 and vertical edge parts 6 and lateral edge parts 7 in the opening of the building and lateral joints and vertical joints between vertically and laterally adjoining cladding units 5 are severally sealed with a waterproof slide fastener and a wet sealing material which will be specifically described hereinafter.

The cladding units 5 mentioned above, as shown in FIG. 2, each comprise a cladding member 15 having a face member 14 fixed to the outdoor side surface of a framework 13 formed by joining an upper frame member 10, a lower frame member 11, and laterally opposite vertical frame members 12 in the shape of a square and fastener stringers 16 attached to the frame members 10, 11, and 12. The fastener stringers 16 are severally paired with those of the cladding units 5 which are adjoined as opposed thereto and, consequently, are enabled to form waterproof slide fasteners in cooperation therewith.

Figure 2:
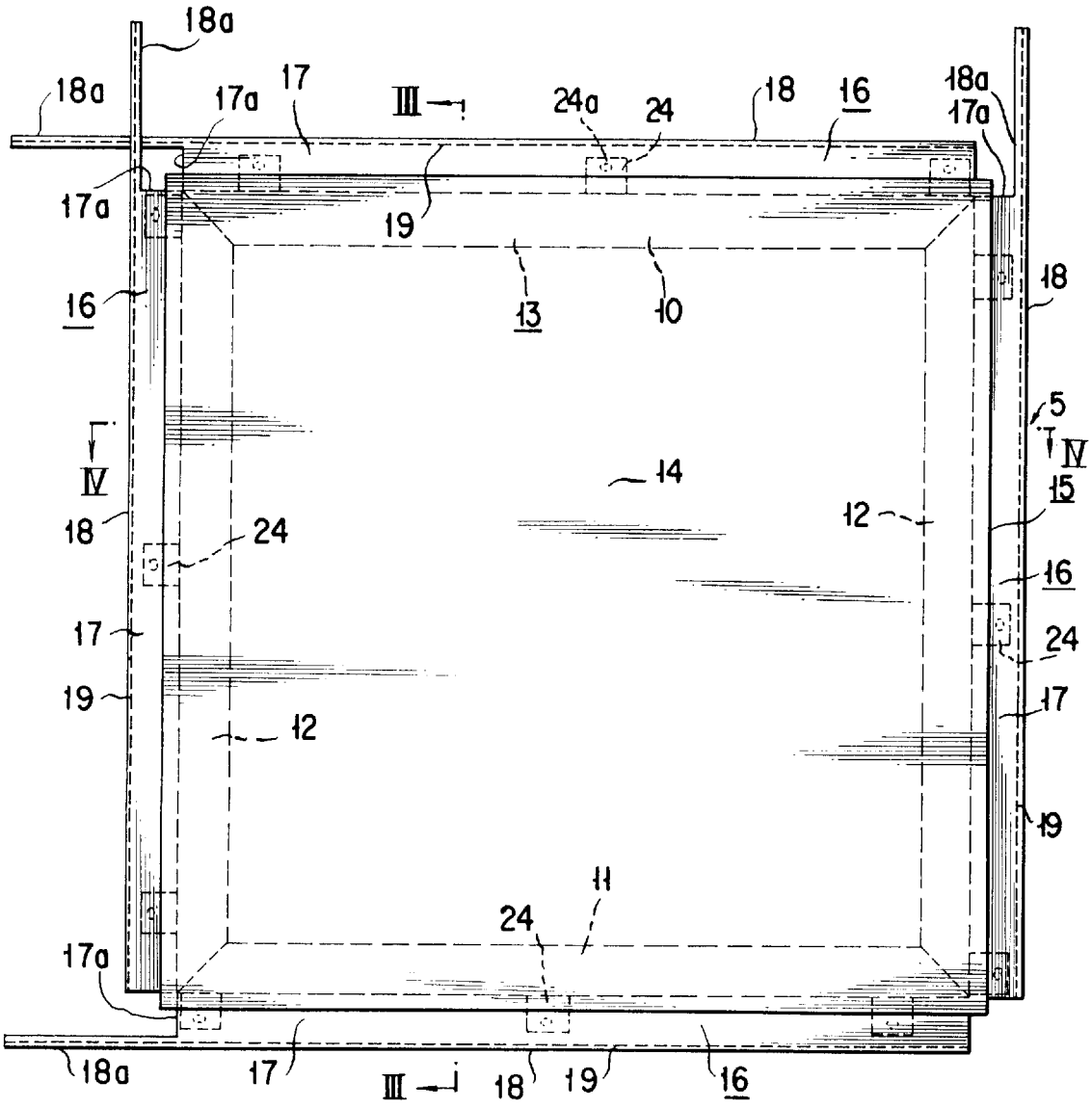
FIG. 2 is front view of a cladding unit.
Figure 3:
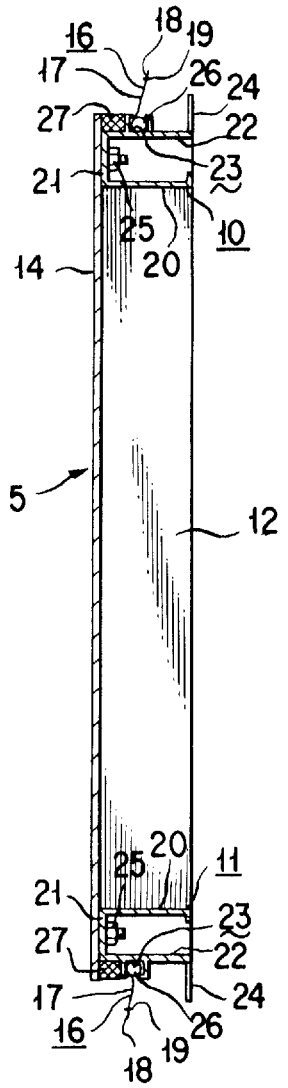
FIG. 3 is a cross section taken through FIG. 2 along the line III—III.

The fastener stringers 16 as illustrated in FIG. 3 each include a waterproof tape 17 and an engaging part 18 extending from the waterproof tape. The engaging part includes a multiplicity of coupling elements 19 which are fixed to the waterproof tape along one longitudinal edge part of the tape. The coupling elements 19 are depicted in FIG. 3 and are also depicted only schematically in FIG. 2 along the engaging part 18 of the waterproof tape 17. The coupling elements 19 are preferably of the form of a multiplicity of elements extending from the engaging part 18 which are adapted to engage with coupling elements of an adjacent waterproof tape in a manner well known in the art and similar to a zipper. The coupling elements 19 are spaced regularly along the longitudinal edge part of the engaging part 18.

Figure 5:
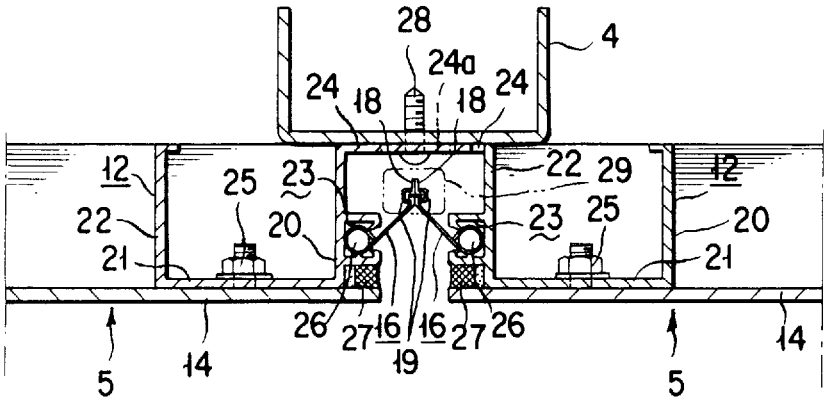
FIG. 5 is a cross-sectional view of a fixing part of the cladding unit.

One end part 18*a* of the engaging part 18 protrudes from one end part 17*a* of the waterproof tape 17 in a longitudinal direction and is adapted to be received or easily inserted into a slide groove of a slider. FIG. 2 best illustrates the end parts 18*a* and 17*a*. A slider element 29 is schematically illustrated in FIG. 5.

Each of the waterproof tapes 17 is preferably made of a substance such as silicon rubber. The waterproof tapes 17, therefore, excel in durability and endure extreme weather conditions satisfactorily. The waterproof tapes 17 also exhibit excellent qualities for adhering to the wet sealing material as is described below. The wet sealing material typically is a silicon sealant whose function is also described below.

As illustrated in FIGS. 2 and 3, fastener tapes are secured along one edge to the cladding units 5 whereby the opposite edge defined by the engaging parts 18 extends freely from the cladding units 5. The multiplicity of coupling elements 19 are, therefore, also spaced from the edges of the cladding units 5.

In the embodiment described above, the face member 14 has been depicted as formed of a plate material. Optionally, it may be made of a glass material, a screen, or other materials.

Figure 4:
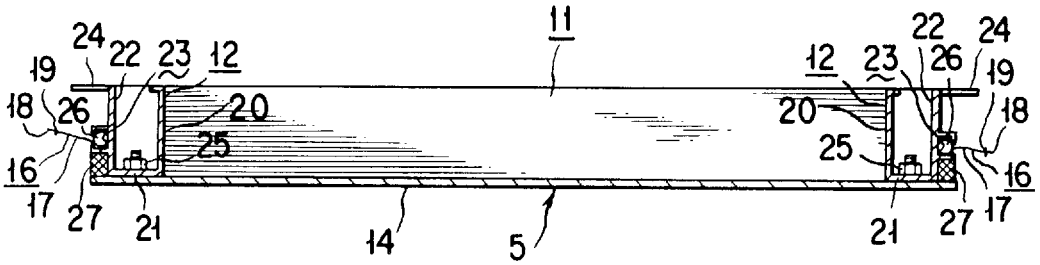
FIG. 4 is a cross section taken through FIG. 2 along the line IV—IV.

The frame members 10, 11, and 12 mentioned above, as shown in FIG. 3 and FIG. 4, each comprise an elongate inner wall part 20, an elongate outer wall part 22, and a connecting part serving to connect the longitudinal edges of these wall parts, which are so joined as to form a cross section roughly in the shape of three sides of a square. On the outside of each of the outer wall parts 22, an outwardly open conduit 23 is formed continuously as extended in the longitudinal direction thereof. Each of the conduits 23 includes a groove defined by two parallel elongate ribs 23*a*, 23*b* raised from the outer surface of each of the outer wall parts 22 of the frame members 10, 11, and 12, as clearly shown in FIG. 7. Each of the ribs has an inwardly projecting pawl portion formed integrally with the free edge thereof so that a linear retaining member is securely fitted in the conduit 23. In the edge of each of the outer wall parts 22, a plurality of outwardly projecting fixing pieces 24 are integrally formed as spaced with prescribed intervals in the longitudinal direction thereof. The face member 14 is fixed with securing devices or fasteners 25 to the connecting parts 21 of the frame members 10, 11, and 12. The fixing pieces 24 protrude outwardly from the face member 14.

The end parts of the frame members 10, 11, and 12 are cut at an angle of 45 degrees and abutted and connected by welding or by the use of a corner block or coupling piece. The longitudinal edge part of each of the waterproof tapes 17 of the fastener stringers 16 is push fit with a linear retaining member 26 such as aluminum wire into the outwardly open conduit 23. The engaging part 18 of each of the fastener stringers 16 protrudes outwardly from the face member 14. The joined parts of the framework 13 and the face member 14 are sealed by filling the gaps between the face member 14 and the outer wall parts 22 with a wet sealing material 27 such as silicone rubber.

The cladding units 5 are assembled at a factory, for example, and then transported to a site for the fixation on a building. The fixing pieces 24 of the vertical frame members 12 of the laterally adjoining cladding units 5 are severally secured with a securing device or fastener 28 such as, for example, a screw to the vertical backing member 4 as shown in FIG. 5 and, at the same time, the fixing pieces 24 of the upper and lower frame members 10, 11 of the vertically adjoining cladding units 5 are severally secured with a securing device such as, for example, a screw to the lateral backing member 3. The fixing pieces 24 each have an oblong hole 24*a* formed therein (see FIG. 6 and FIG. 14). Since the oblong holes 24*a* are so adapted that the securing device 28 may be inserted therethrough, the cladding units 5 are allowed to move in the direction of plane.

In the laterally adjoining cladding units 5, the engaging parts 18 of the fastener stringers 16 attached to the vertical frame members 12 are opposed to each other. The outwardly projecting one-end parts 18*a* of the engaging parts 18 are drawn out from between the laterally adjoining cladding units 5 and are inserted in a slider 29. The slider 29 is moved in the direction of length of the engaging parts 18 to mesh the coupling elements 19 of the engaging parts 18 of the paired fastener stringers 16. The slider 29 is eventually extracted through the other end parts of the engaging parts 18.

Since the waterproof tapes 17 of the pair of the fastener stringers 16 are airtightly and watertightly coupled 5 a result of the procedure described above, the vertical joint between the laterally adjoining cladding units 5 can be sealed infallibly. Since the slider 29 is engaged with the engaging parts 18 on the outer side than between the laterally adjoining cladding units 5, the work of coupling of the fastener stringers is easy to perform.

Since the lateral joint between the vertically adjoining cladding units 5 is sealed in the same manner as described above, it can be sealed infallibly.

The outwardly projecting one-end parts of the engaging parts 18 of the fastener stringers 16 may be either cut off or left per se after they have been coupled by means of the slider 29. In the illustrated examples, they are depicted in a cut state.

Now, the seal structure for the cruciform joint (the part indicated by A in FIG. 1) formed by the vertically and laterally adjoining cladding units 5 will be described below.

Figure 6:
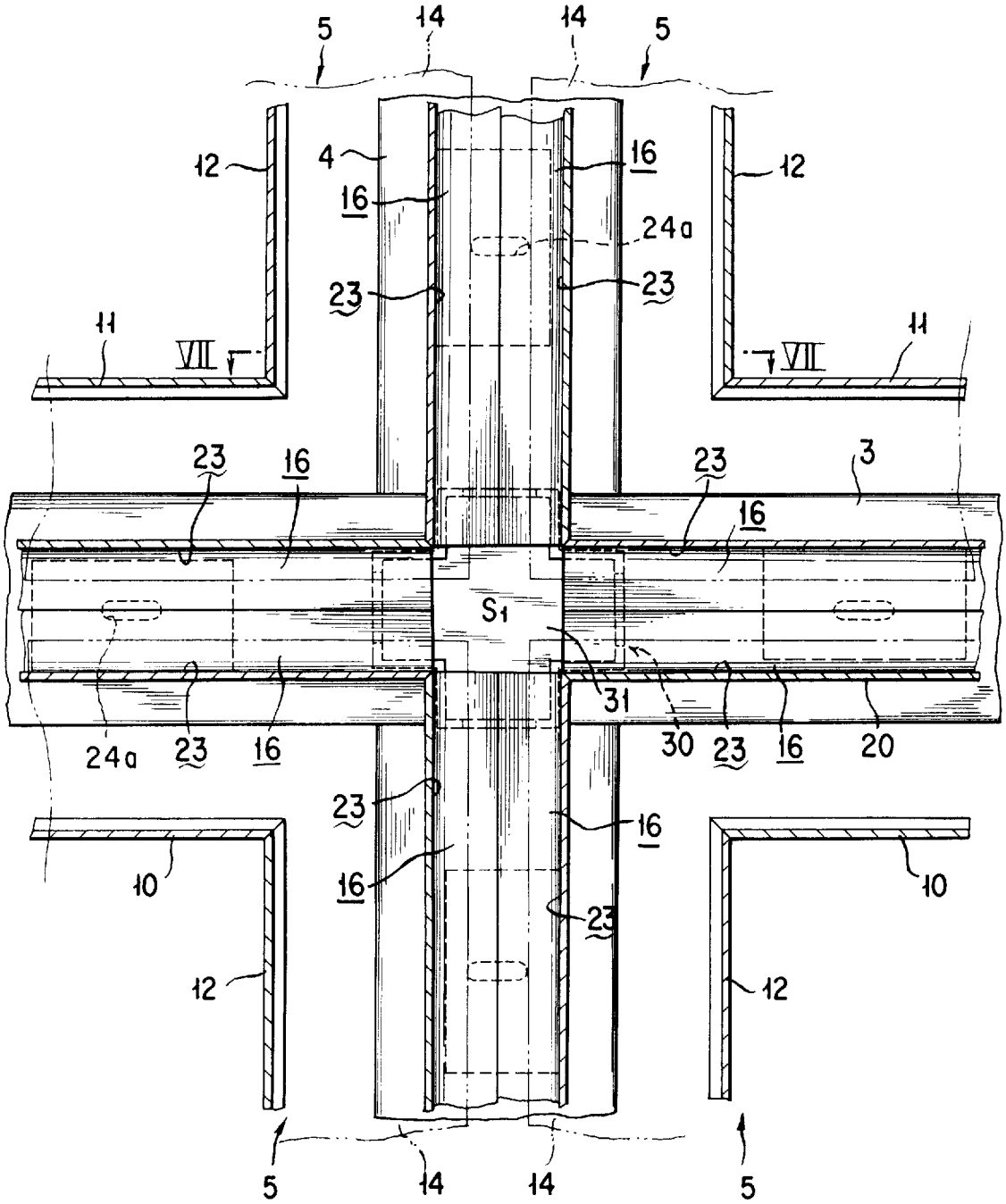
FIG. 6 is a fragmentary longitudinal section of a cruciform joint.

Since each of the fastener stringers 16 has the same length as that of the outwardly open conduit 23 of each of the frame members 10, 11, and 12, the fastener stringers 16 have their continuity interrupted in the cruciform joint resulting from the intersection of the lateral joint and the vertical joint and consequently allow the occurrence of an opening $S_1$ of the shape of a square as shown in FIG. 6.

Figure 7:
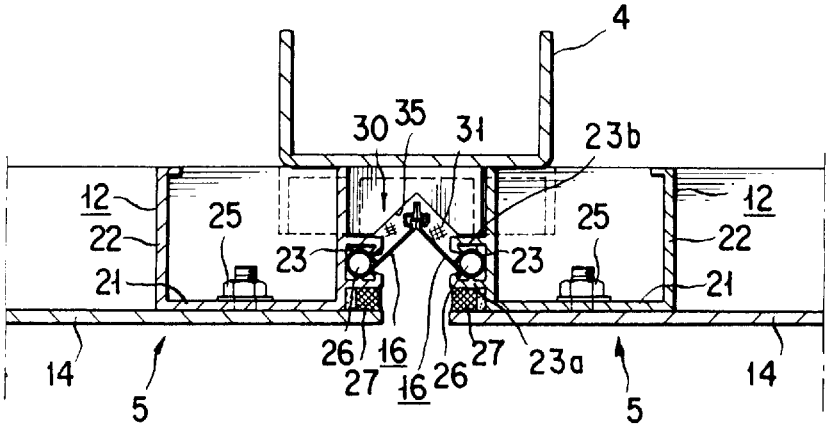
FIG. 7 a cross section taken through FIG. 6 along the line VII—VII.

A cruciform backup member 30, therefore, is disposed s as to thrust out on the rear surface side severally of the fastener stringers 16 in the cruciform joint as shown in FIG. 6 and FIG. 7. The opening $S_1$ is closed by filling the cruciform joint with a wet sealing material 31 and, at the same time, the cruciform joint is sealed by continuing the fastener stringers 16 with the wet sealing material 31.

Figure 8:
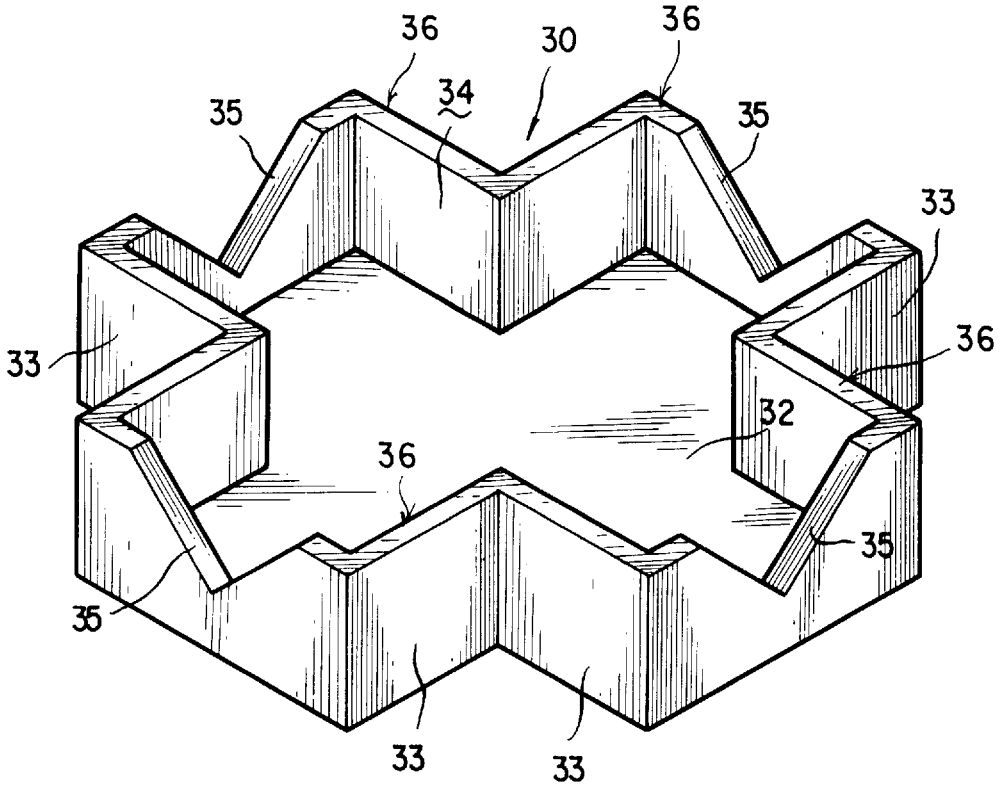
FIG. 8 is a perspective view of a cruciform backup member.

The cruciform backup member 30, as shown in FIG. 8, comprises a cruciform bottom plate 32 and upright plates 3 of a plan shape of three sides of a square disposed one each along the outer edges of the cruciform bottom plate 32 and connected end to end to form a cruciform depressed part 34. The bottom plate 32 is adapted to be fixed by adhesion to the vertical backing member 4. Since the pair of the fastener stringers 16 are coupled substantially in the shape of the letter V so as to absorb possible displacement of the adjoining cladding unit 5 as shown in FIG. 7, a notch 35 substantially in the shape of the letter V is formed in the edge part of each of the upright plates 33. As a result, the protruding portions 36 of the cruciform backup member 30 can be easily inserted in the rear sides of the pairs of coupled fastener stringers 16.

Next, the seal structure for the T-shaped joint (the part indicated by B in FIG. 1) to be formed by adjoining one cladding unit 5 astraddle to two laterally adjoining cladding units 5 will be described below.

Figure 9:
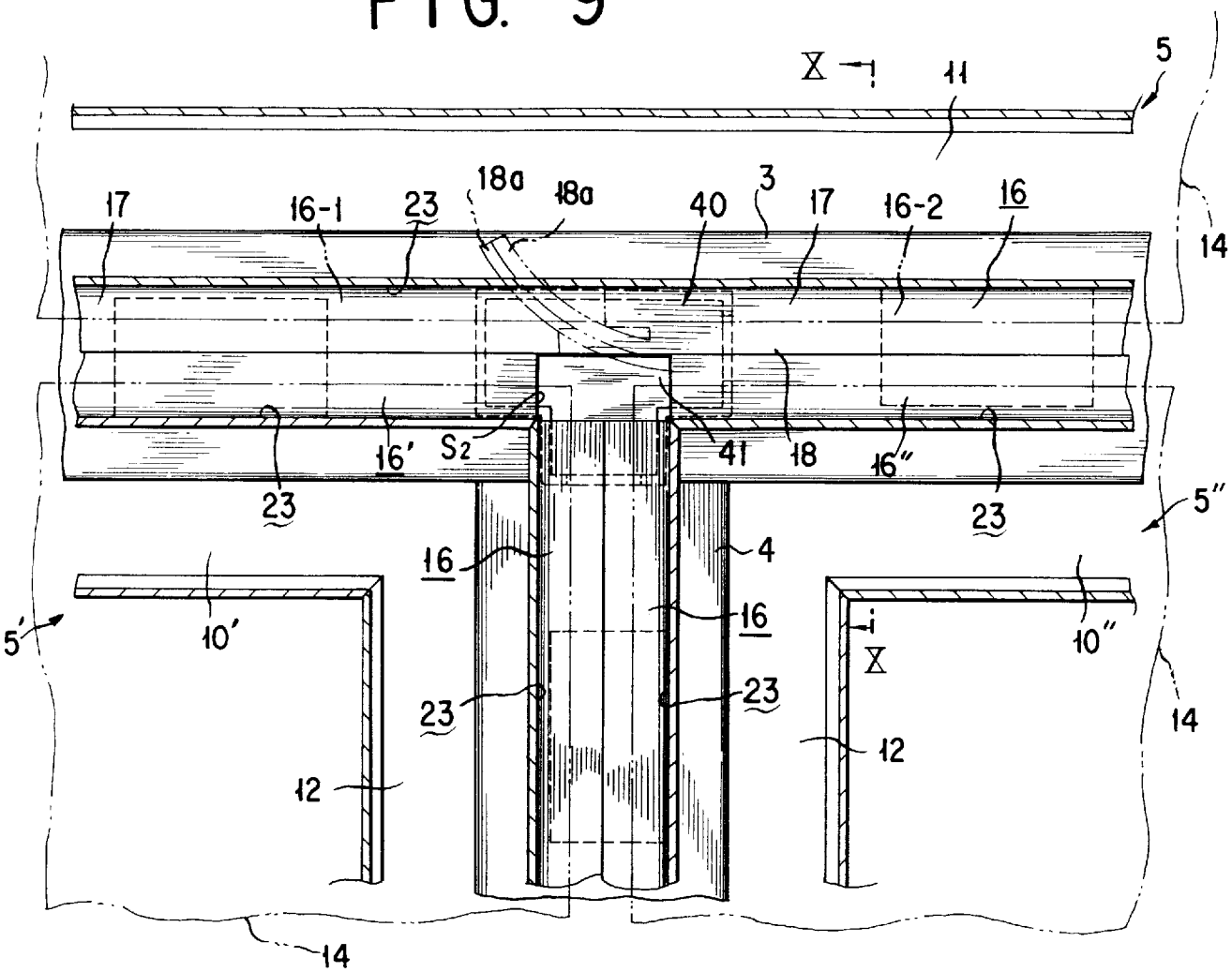
FIG. 9 is a fragmentary longitudinal section of a T-shaped joint.

The left and right fastener stringers 16', 16" severally attached to the upper frame members 10', 10" of the laterally adjoining cladding units 5', 5" are severally coupled with the fastener stringer 16 attached to the lower frame member 11 of the upper cladding unit 5 as shown in FIG. 9. Since the left and right fastener stringers 16', 16" are separated from each other, these fastener stringers 16', 16" have the continuity thereof interrupted in the T-shaped joint resulting from the intersection of the lateral joint and the vertical joint and give rise to an opening $S_2$ of the shape of a square.

Figure 10:
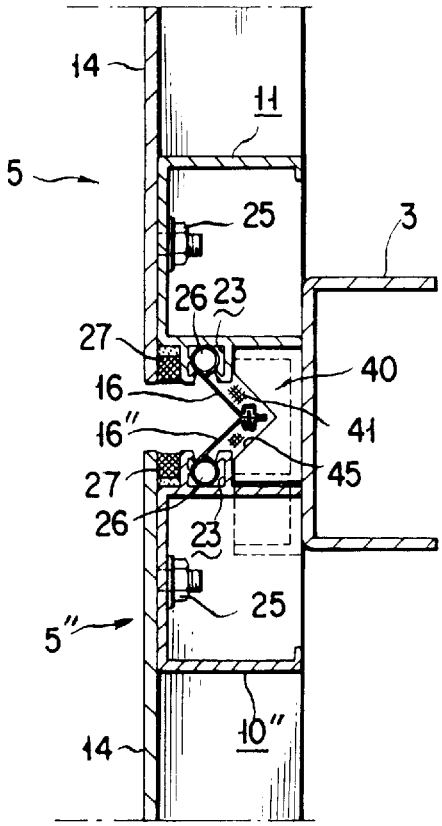
FIG. 10 is a cross section taken through FIG. 9 along the line X—X.

A T-shaped backup member 40, therefore, is disposed 5 as to thrust out on the rear surface sides of the fastener stringers 16, 16', and 16" in the T-shaped joint as show in FIG. 9 and FIG. 10. The opening $S_2$ is closed by filling the T-shaped backup member 40 with a wet sealing material 41 and, at the same time, the T-shaped joint is sealed by continuing the fastener stringers 16, 16', and 16" with the wet sealing material 41.

Figure 11:
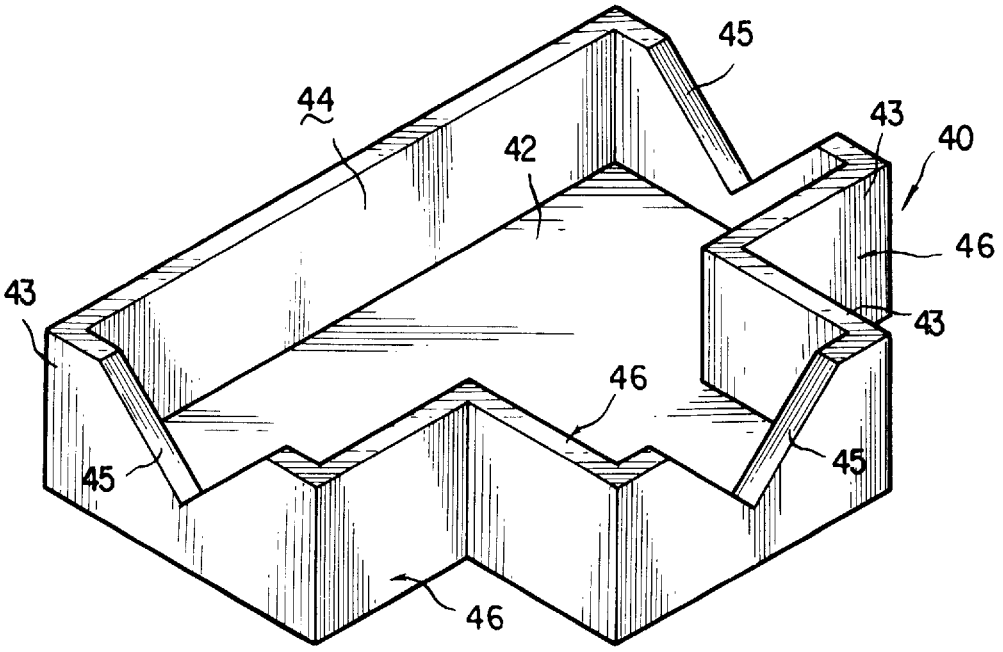
FIG. 11 is a perspective view of the T-shaped backup member.

The T-shaped backup member 40, as shown in FIG. 11, comprises a T-shaped bottom plate 42 and upright plates 43 of a plan shape of three sides of a square disposed one each along the outer edges of the T-shaped bottom plate 42 and connected end to end to form a T-shaped depressed part 44. The bottom plate 42 is adapted to be fixed by adhesion to the lateral backing member 3. Since the pair of the fastener stringers 16, 16'or 16, 16" are coupled substantially in the shape of the letter V so as to absorb possible displacement of the adjoining cladding units 5 as shown in FIG. 10, a notch 45 substantially in the shape of the letter V is formed in the edge part of each of the upright plates 43. As a result, the protruding portion 46 of the backup member 40 can be easily inserted in the rear sides of the pairs of coupled fastener stringers.

The left and right fastener stringers 16', 16" of the lower laterally adjoining cladding units 5', 5" are severally coupled with the one fastener stringer 16 attached to the lower frame member 11 of the upper cladding unit 5 on the opposite longitudinal edge portions relative to the medial portion as the boundary as shown in FIG. 9. It is, therefore, permissible to divide the fastener stringer 16 attached to the lower frame member 11 of the upper cladding unit 5 into a first fastener stringer 16-1 and a second fastener stringer 16-2, bond the divided ends of the relevant waterproof tapes 17 thereof by thermal welding or adhesion, and allow the one-end parts 18*a* of the engaging parts 18 of the second fastener stringer 16-2 and the opposed fastener stringer 16" to protrude from the waterproof tapes 17 in the longitudinal direction thereof as indicated by an imaginary line in FIG. 9.

In such an arrangement, the lower left fastener stringer 16' attached to the upper frame member 10' of the left cladding unit 5' and the upper first fastener stringer 16-1 attached to the lower frame member 11 of the upper cladding unit 5 are coupled with each other by engaging the slider with the left end parts respectively of these fastener stringers and moving the slider along the joint length of these fastener stringers. This slider is removed in the opening $S_2$ in the T-shaped joint. The lower right fastener stringer 16" attached to the upper frame member 10" of the right cladding unit 5" and the upper second fastener stringer 16-2 are coupled with each other by engaging the slider with the medial end parts (the on-end parts 18*a* of the longitudinal engaging parts 18) respectively of these fastener stringers and moving the slider along the joint length of the fastener stringers. Thus, the engagement of the slider with fastener stringers is easily performed.

The T-shaped joint of the lower cladding unit 5 and the upper paired cladding units 5 indicated by C in FIG. 1 is sealed in the same manner as described above.

Now, the seal structure for the end part joint to be formed between the vertically adjoining cladding units 5 and the vertical edge part 6 of the wall of the building 1 (the part indicated by D in FIG. 1) will be described below.

Figure 12:
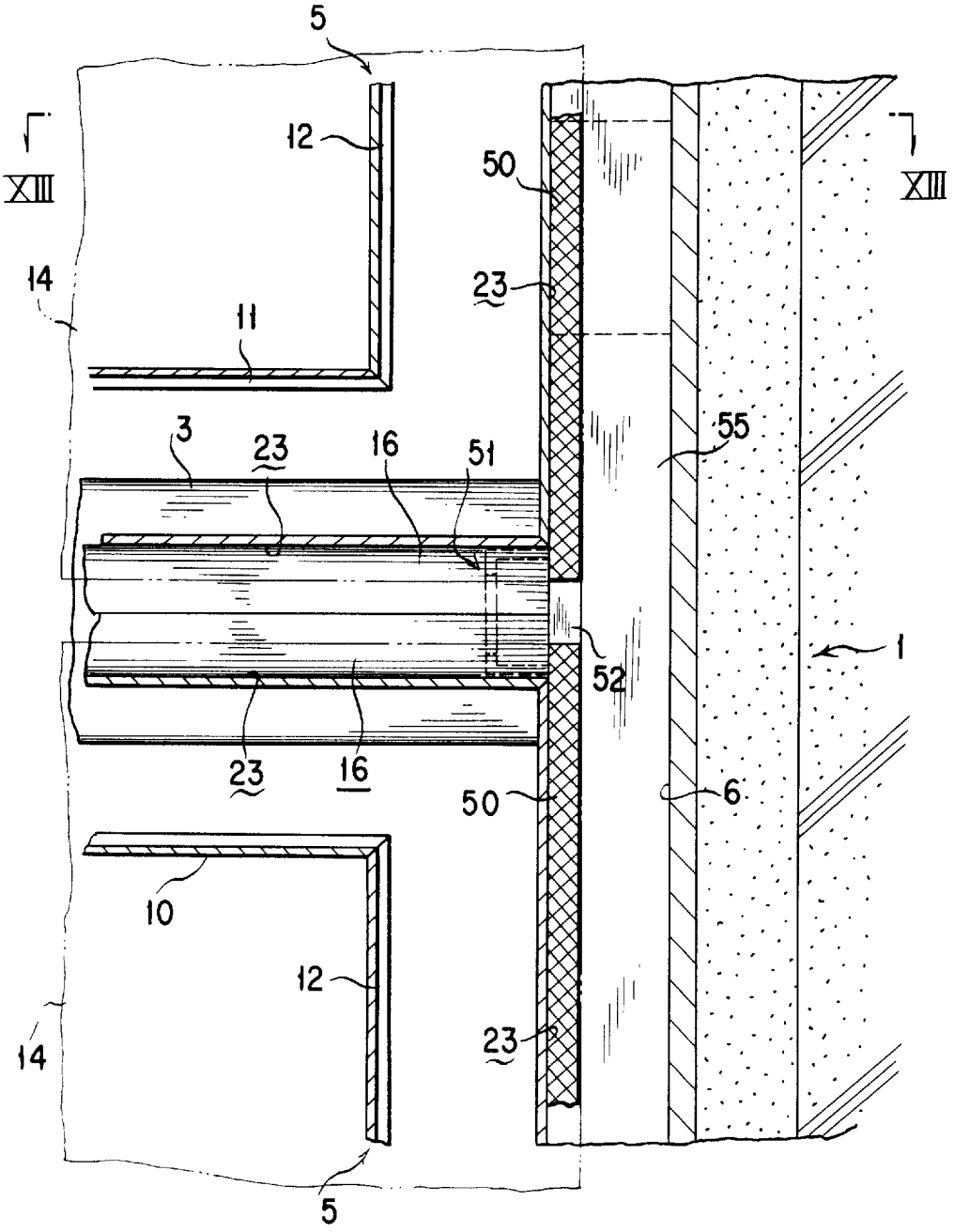
FIG. 12 is a fragmentary longitudinal section of an end part joint.
Figure 14:
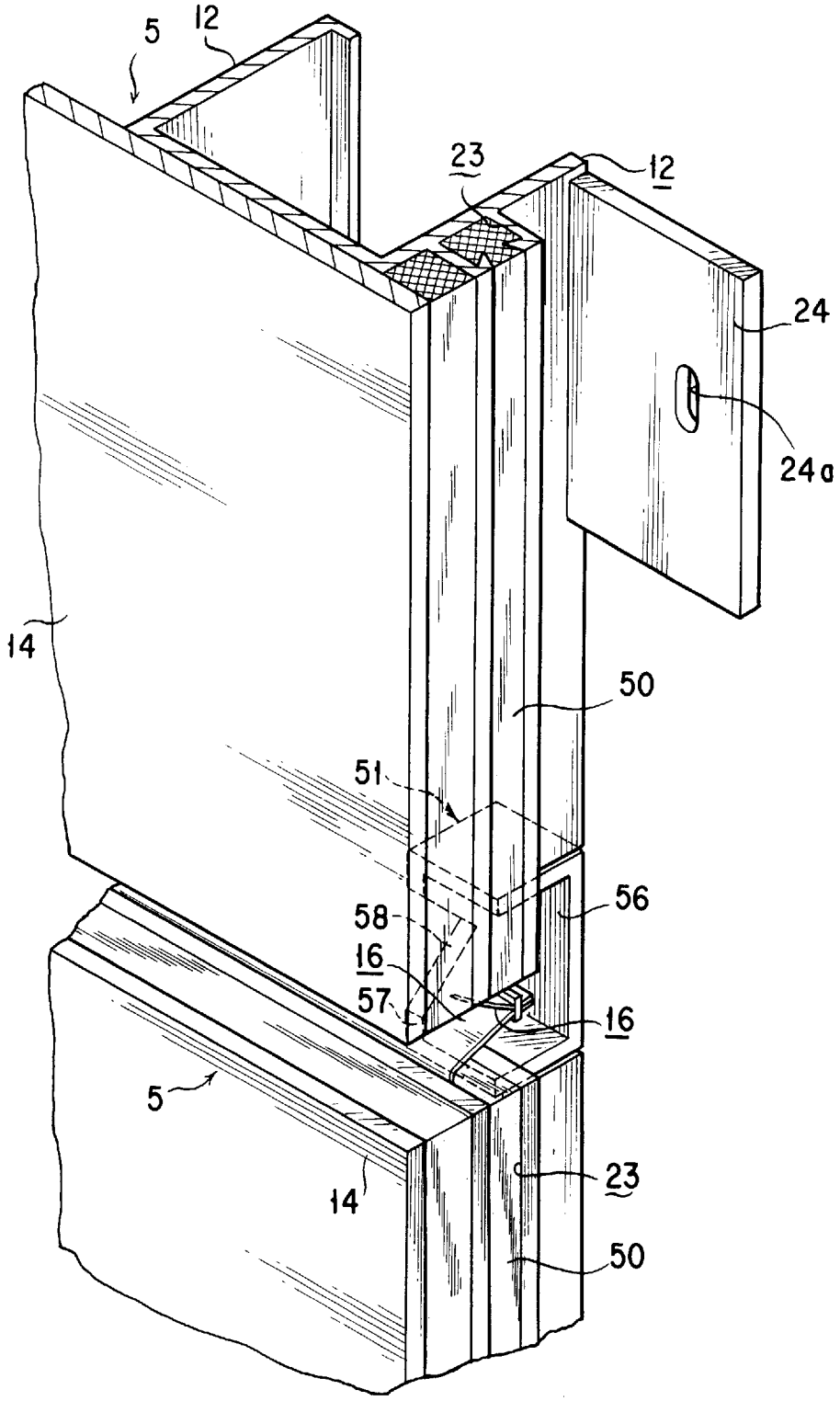
FIG. 14 is a perspective view of a seal part for the end arts of vertically adjoining cladding units.

As shown in FIG. 12, a wet sealing material 50 is packed in the outwardly open conduit 23 of one of the vertical frame members 12 of the cladding unit 5 to be opposed to the vertical edge part 6 of the wall in the opening of the building 1 in advance at a factory, for example, so that the sealing material is brought into contact with the ends of the fastener stringers 16 attached to the upper and lower frame members 10 and 11 of the cladding unit 5 to form a continuous surface therewith. An end part backup member 51 is disposed on the rear surface side of the end parts of the pair of fastener stringers 16 intervening between the lower frame member 11 and the upper frame member 10 of the vertically adjoining cladding units 5 as shown in FIG. 14. The gap between the end part backup member 51 and the rear surfaces of the pair of fastener stringers 16 and the gap between the upper and the lower cladding unit 5 are filled with a wet sealing material 52.

Figure 13:
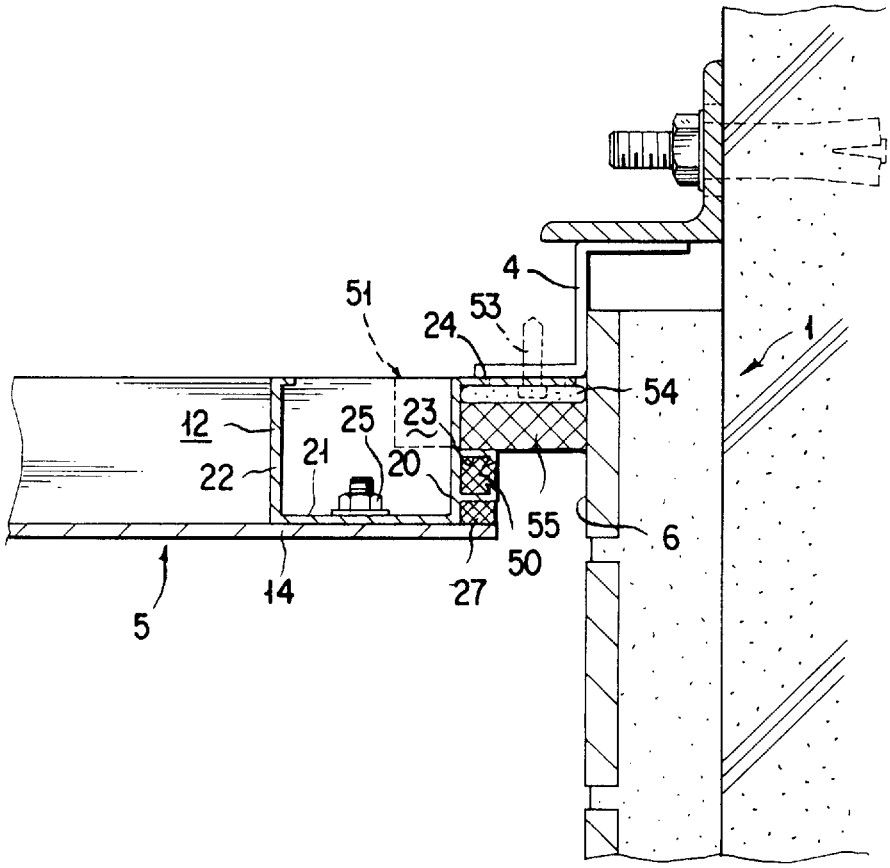
FIG. 13 is cross section taken through FIG. 12 along the line XIII—XIII.

The fixing piece 24 of one of the vertical frame members 12 is fixed with a securing device 53 to the vertical end part backing member 4 secured to the skeleton frame of the building 1 as shown in FIG. 13. The vertical joint formed between the vertical edge part 6 of the wall in the opening of the building 1 and one of the vertical frame members 12 is sealed by filling the vertical joint continuously to the upper and the lower cladding unit 5 with a wet sealing material 55 through the medium of a backup member 54 disposed on the fixing piece 24 along the vertical edge part of the wall. The backup member 54 is formed of a plastic foam such as a hard polyurethane foam.

The end part backup member 51, as shown in FIG. 14, comprises a bottom plate 56 of the shape of a rectangle and upright plates 57 of a plan figure of the shape of three sides of a square integrally formed on the bottom plate 56. A notch 58 of the shape of the letter V is formed in the end part of the intermediate upright plate 57.

Incidentally, the end part joint between the lateral edge part 7 of the wall in the opening of the building 1 and the lateral frame members of the cladding units 5, which is indicated by E in FIG. 1, is sealed in the same manner as described above.

Now, the structure for sealing the joint to be formed between the adjoining cladding units 5 and an obstacle 60 such as the post for an arcade, which is indicated by F in FIG. 1, will be described below on the assumption that the obstacle 60 thrusts from between the adjoining cladding units 5.

Figure 15:
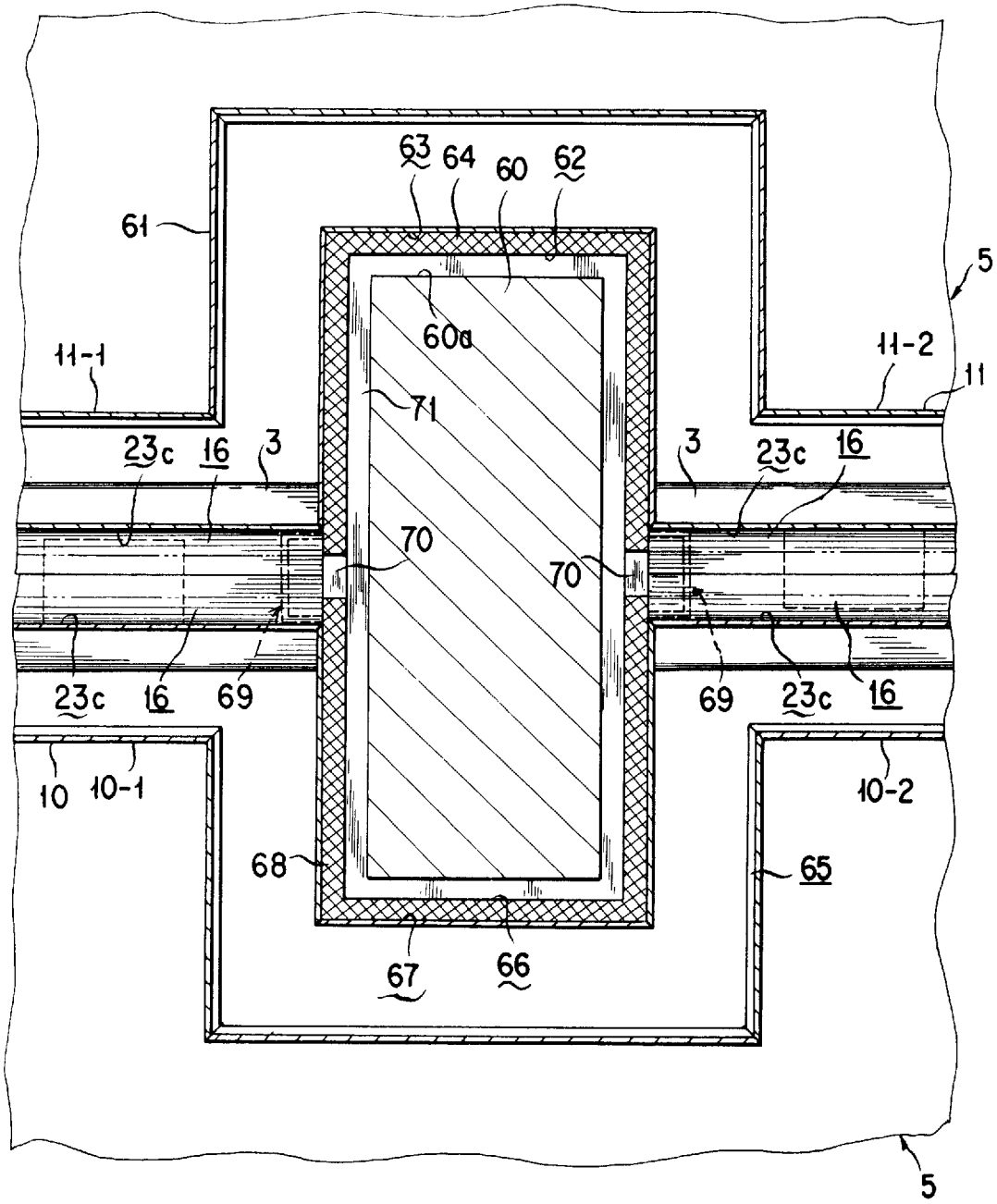
FIG. 15 is a fragmentary longitudinal section of a joint circumscribing an obstacle.

The lower frame member 11 of the upper cladding unit 5 is divided by the obstacle 60 as a boundary into a first and a second frame member, 11-1 and 11-2, as shown in FIG. 15 and the first and the second frame member, 11-1 and 11-2, are connected through the medium of an auxiliary frame member 61 of the shape of three sides of a square to give rise to a depressed part 62 conforming to the contour of the obstacle 60.

The auxiliary frame member 61 is obtained by connecting three frame members having the same cross-sectional shape as the lower frame member 11 end to end in the shape of three sides of a square with a lower open side. This auxiliary frame member 61 is provided with conduits including grooves 63 continuing into the grooves 23*c* of the outwardly open conduits of the first and the second frame member, 11-1 and 11-2. The end parts of the left and right fastener stringers 16 are sealed by filling the grooves 63 with a wet sealing material 64.

Meanwhile, the upper frame member 10 of the lower cladding unit 5 is also divided by the obstacle 60 as a boundary into a first and a second frame member, 10-1 and 10-2, as shown in FIG. 15 and the first and the second frame member, 10-1 and 10-2, are connected through the medium of an auxiliary frame member 65 of the shape of three sides of a square to give rise to a depressed part 66 conforming to the contour of the obstacle 60.

The auxiliary frame member 65 is obtained by connecting three frame members having the same cross-sectional shape as the upper frame member 10 end to end in the shape of three sides of a square with an upper open side. This auxiliary frame member 65 is provided with conduits including grooves 67 continuing into the grooves 23*c* of the outwardly open conduits of the first and the second frame member, 10-1 and 10-2. The end parts of the left and right fastener stringers 16 are sealed by filling the grooves 67 with a wet sealing material 68.

Backup members 69 are disposed one each in the end parts of the upper and lower fastener stringers 16 opposed to the obstacle 60 so as to thrust on the rear surface sides of these fastener stringers 16. The end parts are sealed by filling the gap between the backup member 69 and the rear surfaces of the upper and lower fastener stringers 16 and the gap between the wet sealing materials 64 and 68 packed in the upper and the lower auxiliary frame member, 61 and 65, with a wet sealing material 70. This backup member 69 is formed in the same shape as the end part backup member 51 shown in FIG. 14.

Then, the joints between the obstacle 60 and the upper and lower cladding units 5 are sealed by filling the gap between the upper and lower auxiliary frame members, 61 and 65, connected by the wet sealing material 70 and a peripheral surface 60*a* of the obstacle 60 with a wet sealing material 71.

A platelike backup member is attached to the peripheral surface 60*a* of the obstacle 60 or to the lateral backing member 3 or the vertical backing member 4 so as to permit the packing of the wet sealing material 71.

Now, an embodiment of the cladding unit 5 using the face member made of glass will be described below.

Figure 16:
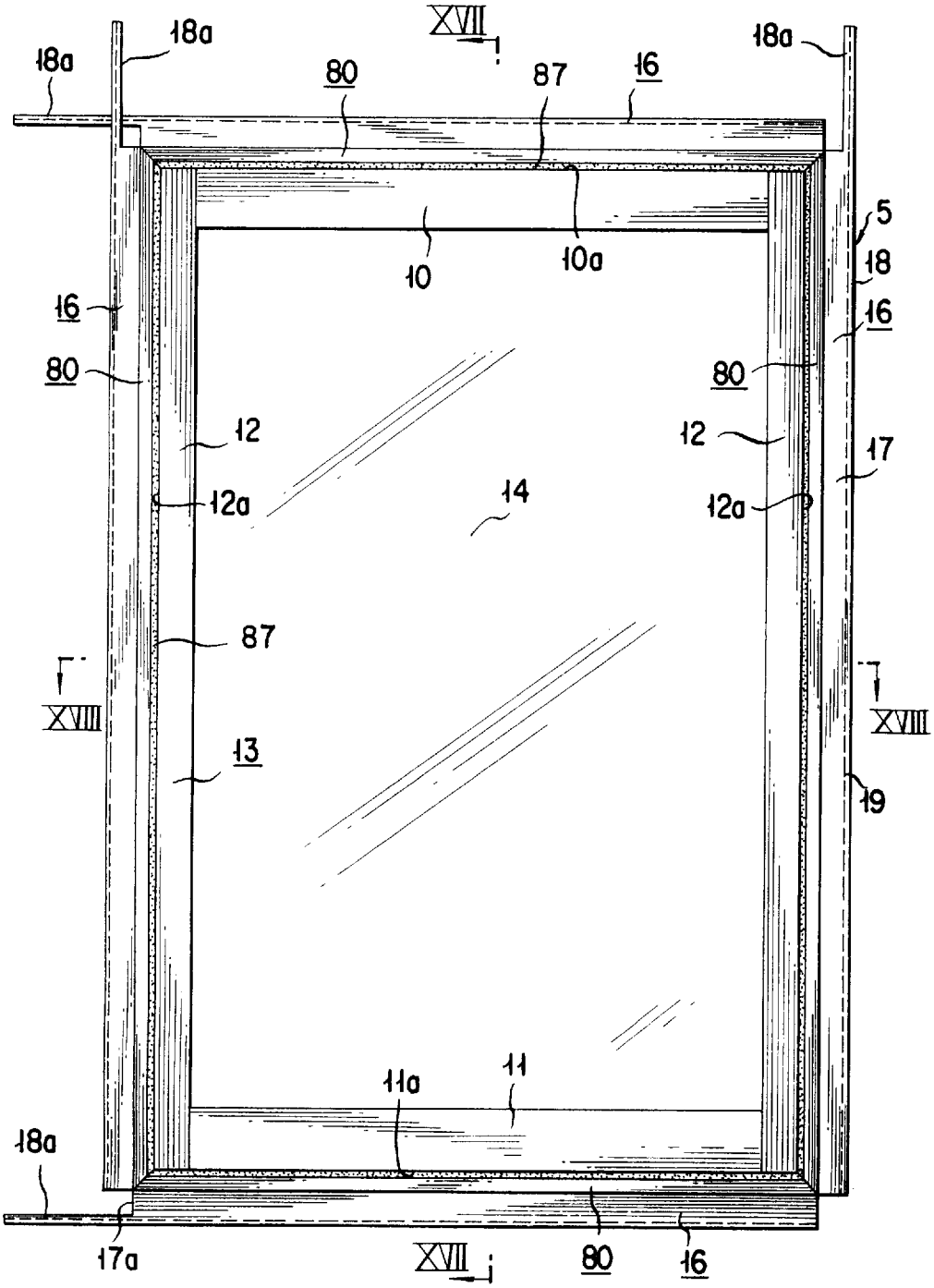
FIG. 16 is a front view of a cladding unit having a face material thereof formed of a glass plate.

The framework 13 is formed, as shown in FIG. 16, by abutting and connecting the opposite ends of the upper frame member 10 to the upper parts of the left and right vertical frame members 12 and the opposite ends of the lower frame member 11 to the lower parts of the left and right vertical frame members 12.

Figure 17:
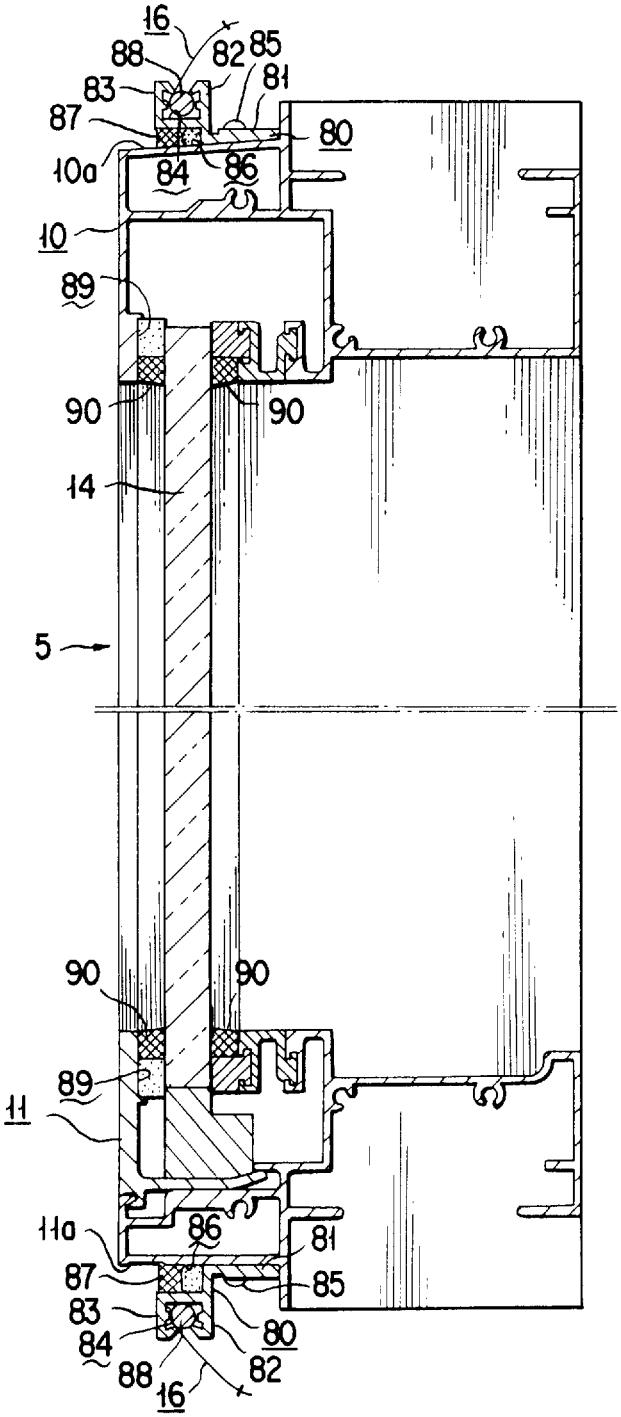
FIG. 17 is a cross section taken through FIG. 16 along the line XVII—XVII.
Figure 18:
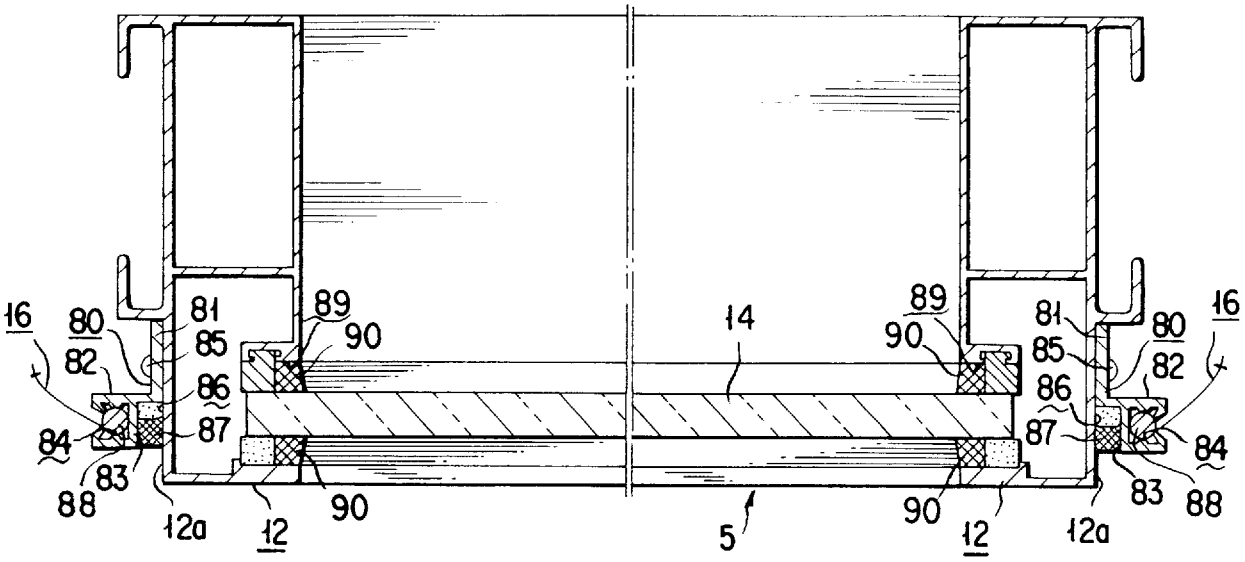
FIG. 18 is a cross section taken through FIG. 16 along the line XVIII—XVIII.

Attachments 80 are fixed one each closely to the outdoor sides in the out-face direction in the outer surfaces 10*a*, 10*a*, and 12*a* in the in-face direction of the frame members 10, 11, and 12 mentioned above. The attachments 80, as shown in FIG. 17 and FIG. 18, are each an elongate of the cross-sectional shape consisting of a fixing piece 81, an outwardly bent piece 82, and a hooked piece 83. The outwardly bent piece 82 and the hooked piece 83 defines an outwardly open groove 84. The fixing pieces 81 are fixed one each to the outer surfaces 10*a*, 11*a*, 12*a* respectively of the frame members 10, 11, and 12 by means of a screw 85. Depressed parts 86 opened on the outdoor side are formed one each between the hooked pieces 83 and the outer surfaces 10*a*, 11*a* and 12*a* of the frame members 10, 11, and 12.

The opposite end parts of the attachments 80 are cut at an angle of 45 degrees and butt joined. The depressed parts 86 are filled throughout their combined length with a wet sealing material 87 to seal the gaps between the framework 13 and he attachments 80.

The face member 14 is formed of a glass plate and, as shown in FIG. 17 and FIG. 18, is attached through the medium of a sealing member 90 to inwardly open groove 89 of the upper frame member 10, the lower frame member 11, and the left and right vertical frame members 12. The cladding unit 5 is an ordinary fixed fit sash.

The longitudinal free edge parts of the waterproof tapes 17 of the fastener stringers 16 serving to form the waterproof slide fasteners are press attached by means of a linear retaining member 88 such as aluminum wire to the outwardly open grooves 84 of the attachments 80.

A frame material intended to form an ordinary fixed fit sash can be applied for the frame members 10, 11, and 12. It suffices specifically to fix the attachments 80 one each to the outer surfaces 10*a*, 11*a*, and 12*a* of the frame members 10, 11, and 12 and attach the waterproof tapes 17 of the fastener stringers 16 to the attachments 80.

Figure 19:
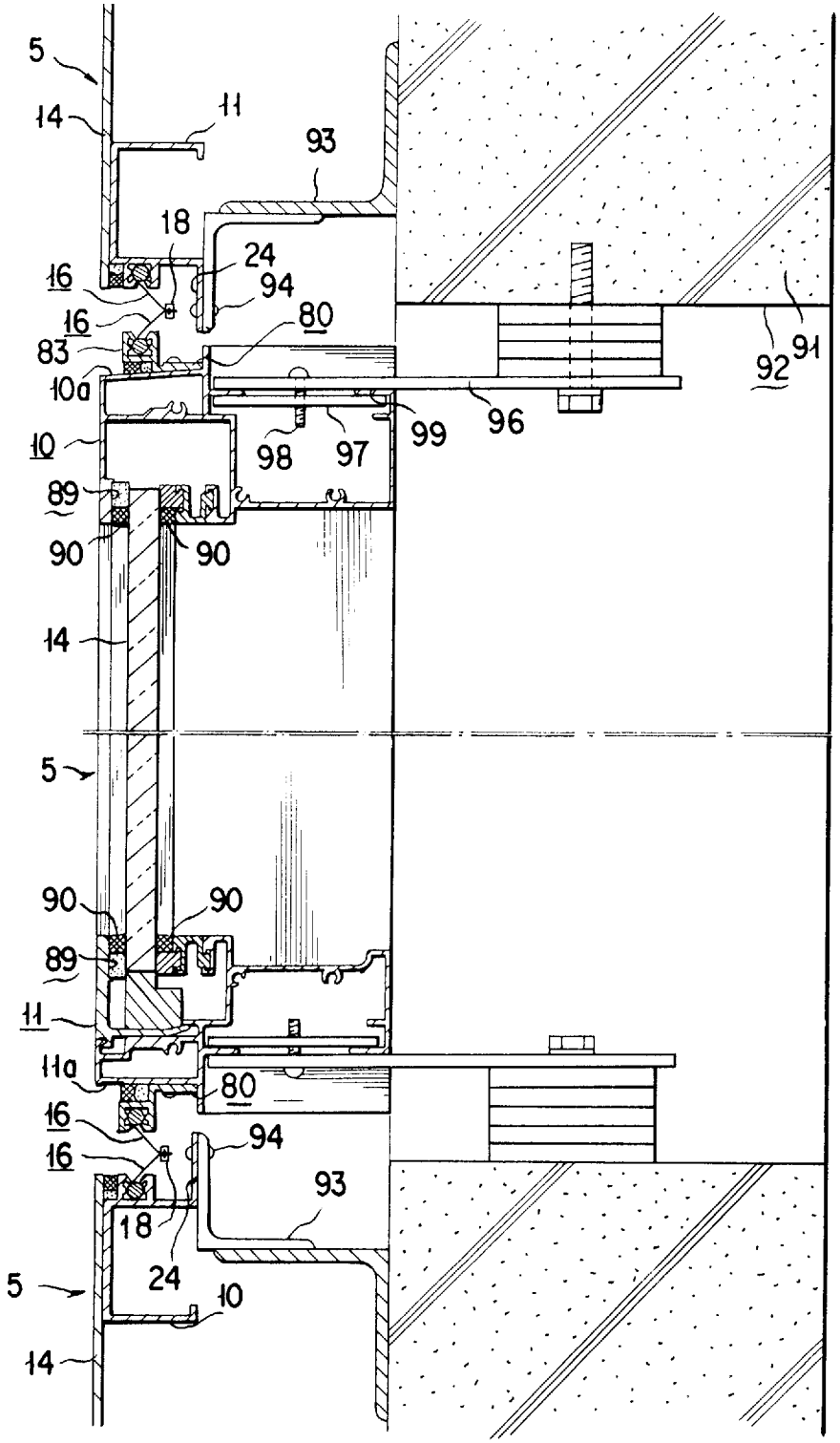
FIG. 19 and FIG. 20 are respectively a longitudinal section and a cross-sectional view showing a connecting part between a cladding unit having a face material thereof formed of a board material and a cladding unit having a face material thereof formed of a glass plate.
Figure 20:
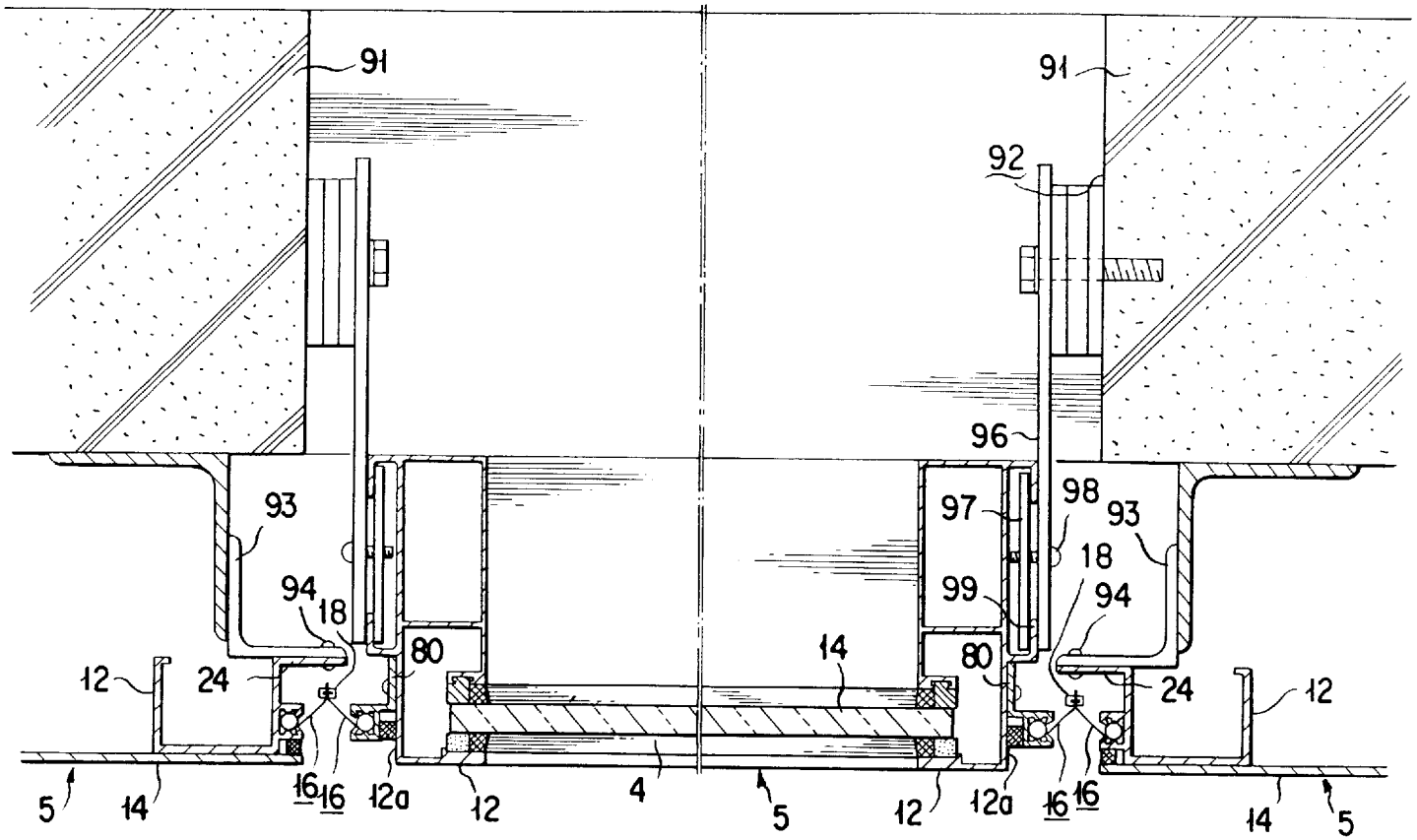

For the purpose of adjoining the cladding unit 5 having the face member 14 formed of a glass plate to the cladding unit 5 of the first embodiment having the face member 14 formed of a board as shown in FIG. 2, it suffices to join the fixing pieces 24 of the frame members 10, 11, and 12 through the medium of fasteners 93 to the edge parts of an opening 92 of a skeleton frame 91 of a building by means of bolts 94, oppose the cladding units 5 to the opening 92 and fix the cladding unit 5 in one plane, and unite the engaging parts 18 of the adjoining fastener stringers 16 by means of the slider 29 as shown in FIG. 19 and FIG. 20. The cladding unit 5 having the face member 14 formed of a glass plate is fixed by causing flange parts 99 of the frame members 10, 11, and 12 to be nipped between a retaining member 97 and a bracket 96 secured to the skeleton frame 91 of the building so as to thrust out from the opening 92 and tying them with screws 98.

Optionally, the attachments 80 may be integrally formed on the outer faces 10*a*, 11*a*, and 12*a* of the frame members 10, 11, and 12. In other words, the outwardly open conduits including grooves may be integrally formed on the outer surfaces 10*a*, 11*a*, and 12*a* of the frame members 10, 11, and 12 serving to form an ordinary sash.

Now, an embodiment of fixing adjoining cladding units 5 in such a manner that their surfaces will not fall flush.

Figure 21:
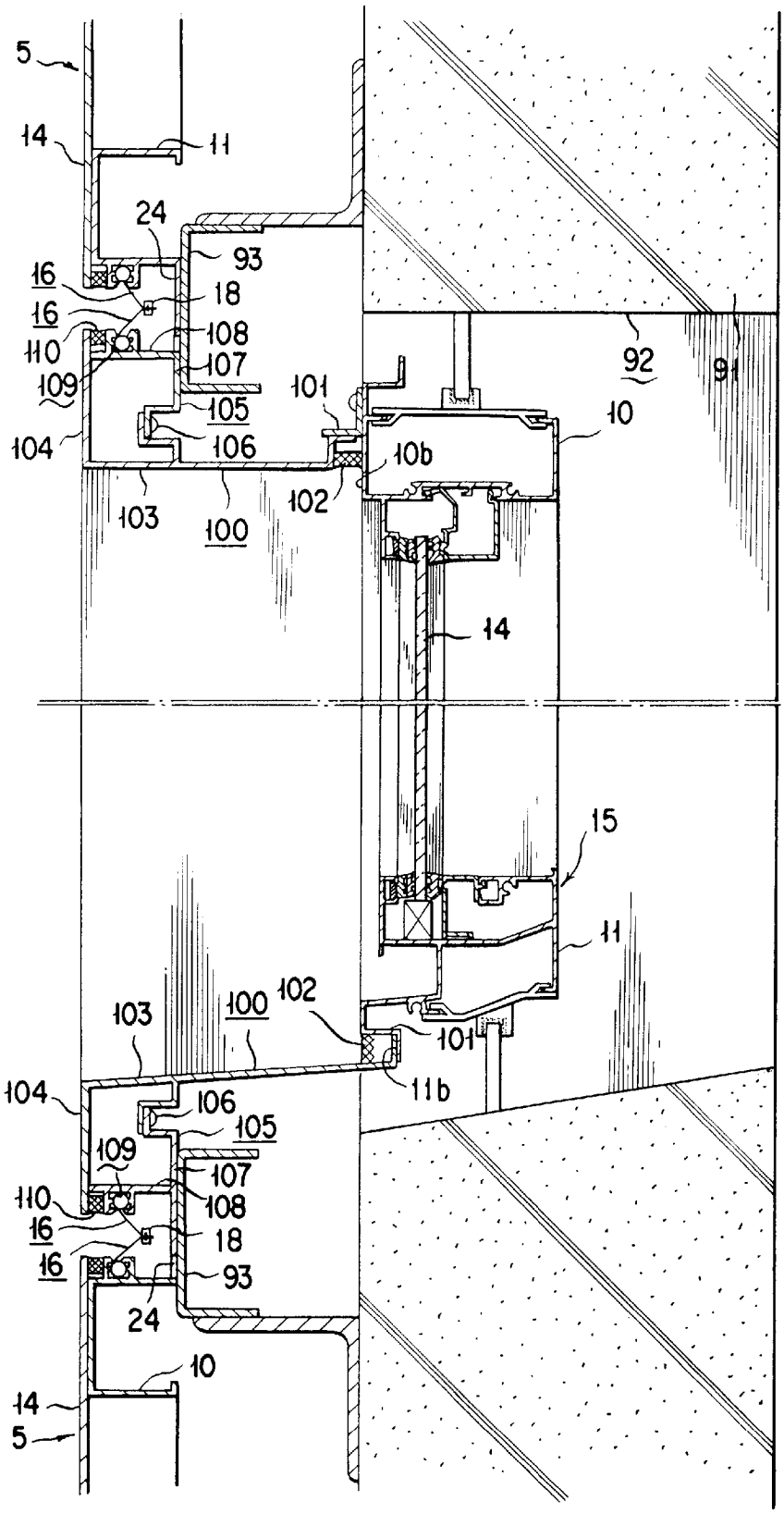
FIG. 21 and FIG. 22 are respectively a longitudinal section and a cross-sectional view showing an embodiment having adjoining cladding units so united that their surfaces do not fall flush.
Figure 22:
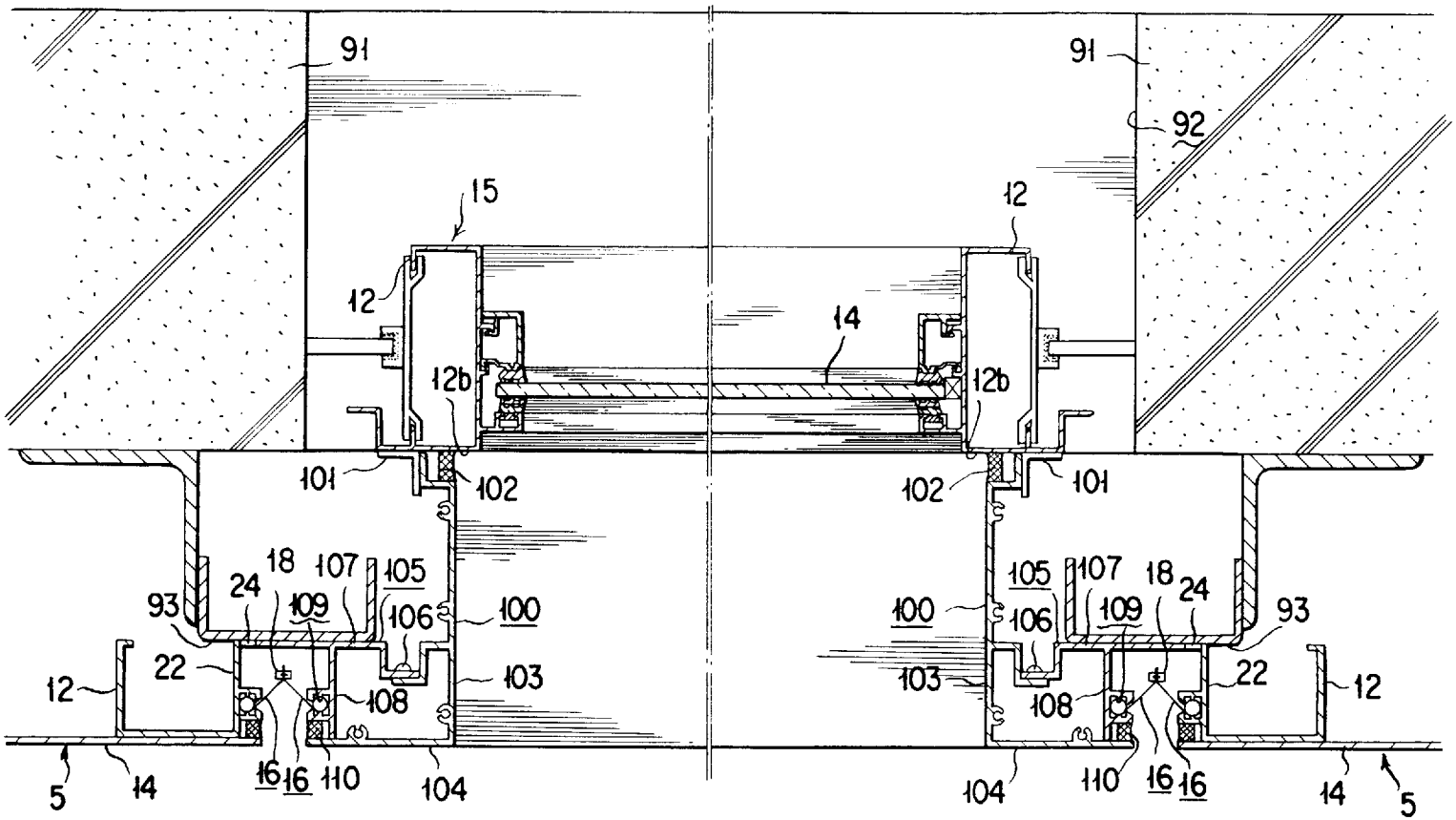

The fixing pieces 24 of the frame members 10, 11, and 12 of the cladding unit 5 having the face member 14 formed of a board are severally coupled to the fasteners 93 and fixed so as to thrust further on the outdoor side than the skeleton frame 91 of the building as shown in FIG. 21 and FIG. 22.

An ordinary cladding member 15 such as, for example, a fixed fitting sash or an open-close sash is disposed inside the opening 92 of the skeleton frame 91 of the building. Outer frames 100 are fixed one each through the medium of an L-shaped piece 101 to outdoor surfaces 10*b*, 11*b*, and 12*b* in the out-face direction respectively of the frame members 10, 11, and 12 of the cladding member 15 and the fixing parts thereof are sealed with a wet sealing material 102. The L-shaped pieces 101 are integrally formed on the lower frame members 11.

The outer frames 100 each comprise a first plate 103 extended in the out-face direction and a second plate 104 extended in the in-face direction and assume a substantially hook-shaped cross section. An attachment 105 is fixed jointly to the first plate 103 and the second plate 104 by means of bolts 106. The attachment 105 is provided with a fixing piece 107 and a projecting piece 108. An outwardly open conduit 109 including groove is formed on the projecting piece 108. The fastener stringer 16 is fixed as mentioned above to the groove of the outwardly open conduit 109. A wet sealing material 110 is filled in the gap between the projecting piece 108 and the second plate 104.

As the fixing piece 107 of the attachment 105 is fixed to the fastener 93, the second plate 104 falls flush with the face member 14 and the adjoining fastener stringers 16 are opposed to each other. The engaging parts 18 of the adjoining fastener stringers 16 are meshed with each other by means of the slider.

Owing to the structure described above, the gaps between the ordinary cladding member 15 and four cladding units 5 can be sealed with the waterproof slide fasteners when the ordinary cladding member 15 is fixed in the opening 92 of the skeleton frame 91 of the building and fixing the cladding units 5 having the face member 14 thereof formed of a board one each to the vertical and lateral edge parts of the opening 92.

While certain specific embodiments have been disclosed herein, the invention may be embodied in other specific forms without departing from the spirit or essential characteristics thereof. The described embodiments are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. A joint seal structure between adjoining cladding units attached to a backing member of a building, said joint seal structure comprising:

cladding units each having a cladding member with a framework and a face member attached to one side face of said framework, said cladding units spaced apart from one another along adjacent edges of each cladding unit defining joints between said adjacent edges;

a waterproof slide fastener stringer attached to each of said adjacent edges of said cladding members, each fastener stringer having a waterproof tape with an engaging part along a longitudinal free edge, the engaging part of each waterproof tape having a plurality of coupling elements;

a seal formed by a coupled engagement of said coupling elements of each of said fastener stringers on said adjacent edges;

gaps defined at end parts of each of said fastener stringers; and a boxlike backup member disposed between said end parts of said fastener stringers and said backing member of said building, and said gaps between said end parts of said fastener stringers and said backing member being sealed with a wet sealing material packed in an empty space of said backup member.

2. The joint seal structure according to claim 1, wherein said backup member is provided with projecting parts thrusting out between said end parts of said fastener stringers and said backing member of said building, said projecting parts having a cross section shape generally in a form of three sides of a square, each having an opening disposed so as to confront a rear side of one of said end parts of a corresponding one of said fastener stringers.

3. The joint seal structure according to claim 1, wherein said backup member has a substantially V-shaped notch formed in an upper edge thereof.

4. A seal structure comprised of a T-shaped joint formed by a first and a second cladding unit arranged in an adjoining state and a third cladding unit arranged astraddle said two adjoining cladding units, said cladding units each comprising a cladding member comprised of a framework and a face member attached to one side face of the framework and fastener stringers of a waterproof slide fastener attached to outer lateral parts of said cladding member, said fastener stringers each comprising a waterproof tape and an engaging part having a plurality of coupling elements attached to said waterproof tape spaced at fixed intervals along one longitudinal edge of the tape;

a first joint between said first and second cladding units being sealed by coupling the engaging parts of opposed fastener stringers of said first and second cladding units in the adjoining state;

a second joint between said first and third cladding units and a third joint between said second and third cladding units being sealed by coupling said engaging parts of said fastener stringers of said first and second cladding units with the opposite engaging part of said fastener stringer of said third cladding unit;

a T-shaped backup member being disposed in a T-shaped joint resulting from the intersection of said first, second, and third joints and end parts of said fastener stringers being continuously sealed with a wet sealing material packed in said T-shaped backup member.

5. The seal structure according to claim 4, wherein one-end part of said engaging parts of the fastener stringers protrudes from one-end part of said waterproof tapes in the longitudinal direction of the tape.

6. A sealed cruciform joint comprising:

first, second, third and fourth cladding units, each having a framework with a vertical and a lateral framework portion and a face member attached to one side face of said framework, each of the cladding units arranged spaced apart and relative to one another defining a cruciform joint having a vertical joint portion and a horizontal joint portion;

a waterproof slider fastener stringer attached to each of said cladding units along said vertical and said horizontal joints, said fastener stringers each having a waterproof tape and an engaging part along one longitudinal free edge of said waterproof tape, the engaging parts having a plurality of coupling elements;

a vertical sealed joint defined by a coupled engagement of said coupling elements along said vertical joint portion;

a horizontal sealed joint defined by a coupled engagement of said coupling elements along said horizontal joint portion;

a cruciform backup member disposed in said cruciform joint at an intersection of said horizontal joint portion and said vertical joint portion; and a wet sealing material packed in said cruciform backup member sealing between said cruciform backup member and end parts of said fastener stringers.

7. The sealed cruciform joint according to claim 6, wherein each of said engaging parts of said fastener stringers includes at least one end part which protrudes from said waterproof tape in a longitudinal direction.

* * * * *